US006462668B1

(12) United States Patent
Foseide

(10) Patent No.: US 6,462,668 B1
(45) Date of Patent: Oct. 8, 2002

(54) ANTI-THEFT ALARM CABLE

(75) Inventor: Knut Foseide, Oslo (NO)

(73) Assignee: Safety Cable AS, Oslo (NO)

( * ) Notice: Subject to any disclaimer, the term of this patent is extended or adjusted under 35 U.S.C. 154(b) by 0 days.

(21) Appl. No.: 09/647,798

(22) PCT Filed: Apr. 6, 1999

(86) PCT No.: PCT/NO99/00112

§ 371 (c)(1),
(2), (4) Date: Oct. 5, 2000

(87) PCT Pub. No.: WO99/52087

PCT Pub. Date: Oct. 14, 1999

(30) Foreign Application Priority Data

Apr. 6, 1998 (NO) ..... 19981569
Oct. 13, 1999 (NO) ..... 19984777

(51) Int. Cl.[7] ..... G08B 21/00

(52) U.S. Cl. ..... 340/687; 340/568.1; 340/568.2; 340/568.3; 340/572.5; 200/61.59

(58) Field of Search ..... 340/568.1, 568.3, 340/571, 572.5, 572.8, 687, 568.2; 200/61.59

(56) References Cited

U.S. PATENT DOCUMENTS 4,855,719 A 8/1989 Posey
5,418,521 A 5/1995 Read
5,525,965 A * 6/1996 Liebenthal ..... 340/568.3
6,150,940 A * 11/2000 Chapman et al. ..... 340/568.3
6,337,633 B1 * 1/2002 Forseide ..... 34/687

* cited by examiner

*Primary Examiner*—Julie Lieu
(74) *Attorney, Agent, or Firm*—Young & Thompson

(57) ABSTRACT

An anti-theft alarm cable, wherein the circuit between a sound generator (1) and a battery (2) is made when an attempt is made to remove a power cable from its permanent location between an electrical appliance and the main supply, characterized in that the sound generator (1) and battery (2) are encapsulated in the rear part of the connector. There is a diaphragm and sound holes in the connector which let sound from the sound unit pass out of the connector. There is a locking device in the front pan of the connector wherein a metal piece presses out of the connector and into the wall of the input terminal to ensure that the connector remains in the input terminal. A transformer can be built into the plug and conduct DC to PCB 2 through two extra conductors in the power cable.

6 Claims, 7 Drawing Sheets

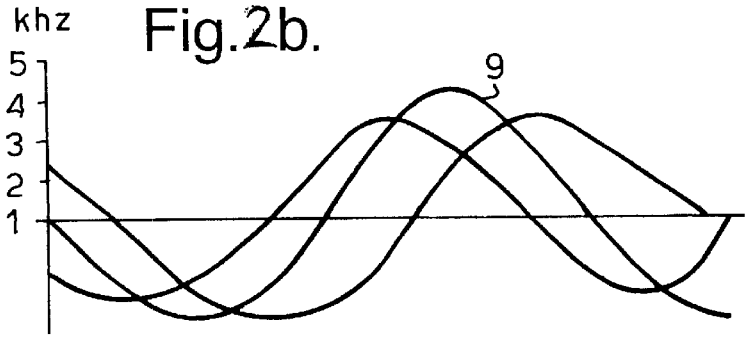
Fig.2b.
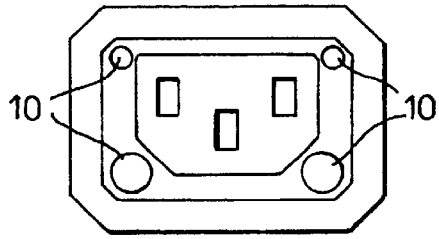
Fig.3
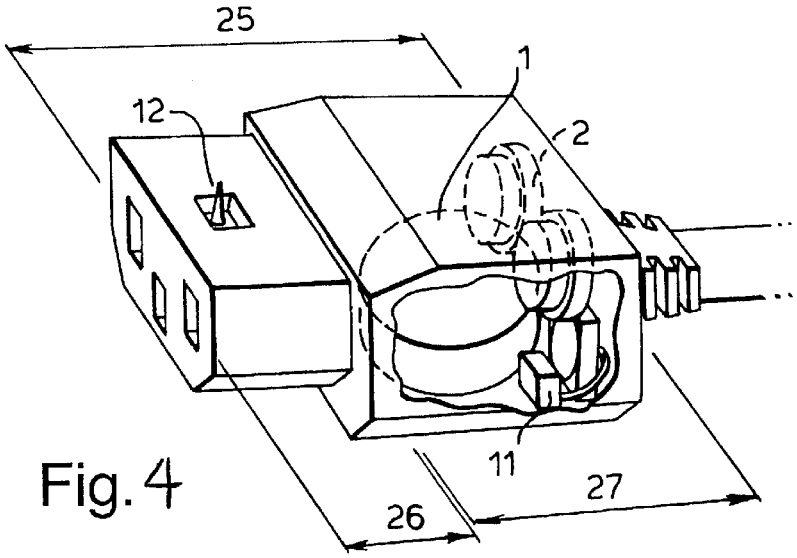
Fig. 4
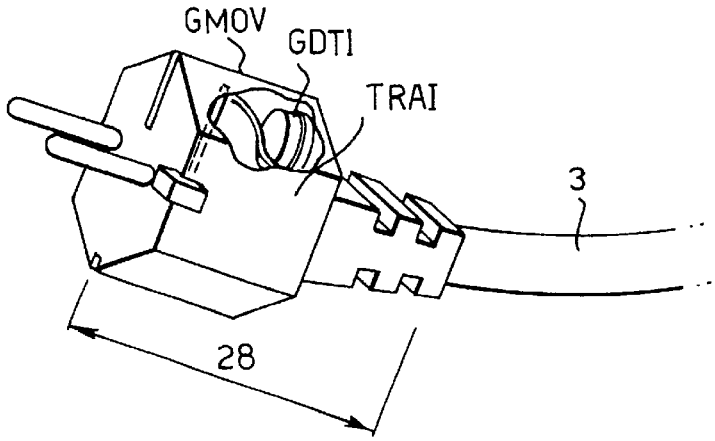

ANTI-THEFT ALARM CABLE

PRIORITY

Norwegian Patent Application No. 19981569 (description/figure) Cited documents—19981569; U.S. Pat. No. 5,418,521.

EXPLANATION OF TERMS (See FIG. IV)

Bipolar earthed power cable (8)=current-carrying cable having a minimum of 3 conductors (2 for phase, 1 for earth) which connect the poles in the male connector at one end of the cable with the poles in the female connector in the other end of the cable. In addition there may be several conductors to DC alarm circuits.

Connector (25)=female connector in the end of the cable which is inserted into the power input terminal on the appliance to be secured. Certified electric equipment, NEMKO (Norwegian Board for Testing and Approval of Electrical Equipment) gr 03 63000, C13 for CLASS 1 equipment, Plug (28)=male connector in the end of the cable that is connected to the mains supply (e.g., in a wall socket) 'Front part (26) of the connector=the part of the connector that is inserted into the input terminal 'Rear part (27) of the connector=the part of the connector that projects from the input terminal 'Chassis=the box around the electrical appliance that is to be secured by the anti-theft alarm cable 'Sound unit=sound generator (1) and associated battery or accumulator (2) 'PCB 2=printed circuit board with the components which can be seen in the diagram in FIG. VIIc)

DESCRIPTION

The invention relates to a bipolar earthed power cable which supplies power to electrical appliances and at the same time has an anti-theft alarm function, wherein the sound generator unit (sound generator+battery) is encapsulated inside the rear part of the connector.

Anti-theft alarm products for electrical appliances that are available today provide inadequate solutions, and do not offer sufficiently good protection against many opportunist thieves. The anti-theft alarm cable is constructed so as to prevent thefts of electrical appliances, especially during the day time, from institutions where even a good admittance control is not enough to stop the thieves.

According to the applicant, an anti-theft sound alarm for electrical appliances should be based on two major criteria: 1) The audible alarm unit (sound generator+battery) must be placed in or close to the chassis of the appliance that is to be secured, primarily to hinder the destruction or deadening of the sound generator. 2) The alarm unit should be securely locked inside the appliance that is to be secured to prevent so-called "hit and run" thefts, where the alarm is cut off, pulled off or in some other manner removed from the apparatus that is to be secured, whereupon the thief runs off with the apparatus and leaves the alarm wailing.

The said criteria can best be fulfilled by a sound-generating alarm integrated in a standard power cable (bipolar earthed) for electrical appliances because: 1) Not all electrical appliances have space available for internal installation. 2) It simplifies the installation of the alarm.

With the anti-theft alarm cable according to the invention, it is ensured that the power cable warns of attempted theft in that the circuit between a sound generator and a battery (optionally an accumulator) is closed upon an attempted unauthorised removal of the power cable from its location between the mains supply socket outlet and the input terminal on the electrical appliance which is secured. Detection of any unauthorised removal can be effected in several ways as described in more detail later in the application.

The essential feature of the anti-theft alarm cable according to the invention is that the sound generator and the battery are positioned as close as possible to the appliance that is to be secured, and furthermore that the encapsulation of the sound generator and battery can be locked in the apparatus that is to be secured.

Anti-theft protection of electrical appliances is achieved according to the invention by closing the circuit between a sound generator and a battery in the event of any unauthorised removal of the anti-theft alarm cable, wherein the sound generator and the battery are encapsulated in the rear part of the connector (FIG. Ia)+b) and FIG. IIa)), so that:

1. The sound unit is protected from sound deadening by an unauthorised person putting the sound unit in a bucket of water or the like.
   - If the sound unit had been placed along the actual cable instead of in the connector, the thief could have placed the sound unit in a container filled with water, and thus prevented the alarm from being heard when he pulled it out, cut it off or in some other manner removed the anti-theft alarm cable from the appliance to be secured.
2. Physical destruction of the sound unit, for example, by striking it with a hammer or sledge hammer, using a drill or pliers and so forth, will be hindered.
   - The appliance that is to be secured is in the way of the tool when this task is to be done, thus preventing the tool from gaining access to the critical components.
   - The apparatus that is to be secured may be destroyed instead of the sound unit in the event of this type of attempted manipulation.
3. It is more difficult to deaden the alarm sound by covering the sound unit with sound-deadening materials such as a bundle of wet clothes:
   - Because the sound-deadening material is not around the whole sound unit.
   - Because the area around the input terminal of the electrical appliance is not usually completely uniform (owing to the frame around the input terminal, other connectors or cables and chassis screws and so forth), which makes it difficult to deaden the sound even with good insulating material.
   - On a number of electrical appliances in the field of application of the anti-theft alarm cable, there are slots and holes around the input terminal which will allow sound into the actual casing around the appliance that is to be secured, so that the sound from the sound unit will not be deadened sufficiently in any case, provided that the sound unit is located in the connector.
4. The sound from the sound generator can be amplified by reflection against the appliance chassis (in the area around the input terminal).
   - A diaphragm having natural frequency identical to that of the sound generator can be directed towards the appliance chassis, so that the amplitude of the sound waves which are reflected from the chassis are intensified in intersections between the intersecting sound waves.
   - See FIGS. IIa)+b)
5. Sound holes can be made in the front of the rear part of the connector, so that when an unauthorised persons begin to pull the anti-theft alarm cable out of the appliance that is secured, the following happens:
   - The sound is amplified considerably in that it is sent out directly from the resonance chamber in the rear part of the connector through open holes.

The sound from the resonance chamber is sent directly into the appliance chassis wall, which reflects it so that the amplitude is further intensified because of interference.

According to the inventor, open sound holes are only justifiable when placed in the front of the rear part of the connector, because unauthorised persons could otherwise fill up the resonance chamber with sound-deadening material, such as foam, fluid or the like. There are 2–3 mm of air in this gap too, which lets out sound directly from the resonance chamber also when the anti-theft alarm cable is right inside the input terminal.

See FIGS. III and IIb).

PCB 2 and the sound unit may be placed inside a metal screen of 0.1 to 0.5 mm of spring steel, before plastic is optionally cast around it.

PCB 2 in the alarm circuit may also be placed inside the connector, and microswitches (tamper controls) can be placed on each side of the circuit board, the pressure arm of which projects the length of its stroke from the circuit board, directed towards each interior of the walls of the metal screen, so that when pressure is exerted on the rear part of the connector from the outside, the metal screen will depress the microswitches, which are connected in the circuit in such a way that they then trigger the alarm. This will trigger the alarm in the event of most attempts at physical manipulation of the anti-theft alarm cable. In addition, microswitches may be placed in the front part of the connector with the pressure arm positioned out towards the wall of the input terminal, so that if an unauthorised person tampers with the connector, the switches will be closed towards the input terminal walls, and trigger the alarm. PCB 2 does not need to be in the connector if the circuit between the battery and the sound generator is closed by a relay which keeps the circuit open with current from PCB 2, but triggers the alarm if there is a loss of current from PCB 2.

In this application the alarm will wail even if the cable is cut right at the connector.

See the component positioning in FIGS. IIa) and IV, and the diagram in FIG. V.

Anti-theft protection of electrical appliances is achieved according to the invention in that the circuit between a sound generator and a battery is closed in the event of any unauthorised removal of the anti-theft alarm cable, wherein the sound generator and the battery are encapsulated in the rear part of the connector, and also in that in the connector there is installed a locking device which acts so that a metal piece is pressed out of the front part of the connector (which expands its volume on connection) and into one or more input terminal walls—when the connector is inserted into the input terminal. The locking device is secured with a screw, a pin or a bobbin in an electromagnetic coil which is located in the rear part of the connector, in such a position that it cannot be reached by an unauthorised person without the alarm being triggered. The advantages of this are:

The anti-theft alarm cable does not fall out and trigger the alarm because of its weight load, or because someone pulls out or trips over the wrong cable.

The anti-theft alarm cable cannot simply be pulled out by an unauthorised person, which means that "hit and run" thefts are made difficult.

Nor can unauthorised persons put a sound-deadening material, for example, a wet towel, around the sound unit and then pull it out and throw it straight into a bucket of water to stop the sound.

A lock in the connector as distinct from, for example, a chain, wire or bolt securing the alarm in the chassis,—simplifies the installation considerably.

See FIG. VIa).

Locking of the connector in the input terminal is achieved by the connector having a metal piece embedded therein in the top and/or the bottom of the front part. This metal piece is so shaped—and rests in a groove of a shape which means that—the metal piece moves out of the front part of the connector and is forced in part into the input terminal when the connector is connected to the input. When the connection has been made, the metal piece is secured with a pin so that it can no longer move inside the connector. This pin must then first be removed before the connector can be disconnected from the input terminal without the use of force. When the connector is then pulled out of the input terminal, the metal piece will again withdraw down into the connector because of the shape of the groove in which the metal piece in the connector lies.

See FIG. VIb).

ALTERNATIVE EMBODIMENTS

The locking device may be a metal piece which upon insertion of the connector into the input terminal, is pressed into the wall(s) of the input terminal by the effect of force from an underlying inclined face. FIGS. VIc) and d).

The locking device may be a lever which presses a metal part into the input terminal wall(s), and is locked in the same way as the locking device above. FIG. VIe).

The locking device may be a screw which is screwed directly into the input terminal wall, and is locked in the same way as the locking device above. FIG. VI f).

The alarm electronics can be operated by a battery eliminator which transforms mains supply voltage to weak direct voltage, and which also can supply an optional accumulator with charging voltage. The transformer may be encapsulated in the plug, with two extra conductors through the power cable to the connector, which supply the rest of the alarm electronics with direct voltage.

By encapsulating a transformer in the plug, extra weight load on the input terminal is avoided.

At the same time, the size of the connector is kept to a minimum, so that it does not get in the way of other cables or connectors located in the vicinity of the input terminal.

FIG. IV.

It may be sensible to integrate lightening and surge protection into the anti-theft alarm cable, preferably in the form of a varistor and a gas discharger which are connected in parallel relation across the mains supply phase. The varistor and the gas discharger may be encapsulated in the plug for the same reasons as those that applied to the transformer FIGS. VI and VIIb).

The alarm electronics may advantageously be activated or deactivated by a keypad at a point along the power cable. In institutions where many appliances are to be secured, and the personnel on duty changes, all forms of physical keys are a burden, as they either must be handed over when shifts change (a nuisance), have a permanent place that many know about (low level of security), or must be copied in large numbers for all responsible persons (low level of security).

Choice of Materials:

The rear part of the connector may be a metal box (e.g., aluminium), or the whole connector can be cast in plastic (e.g., glass-reinforced polyamides).

If the appliance is cast in plastic, the sound unit and PCB 2 can be placed in a "box" of spring steel which protects and triggers microswitches (tamper controls) which are located around PCB 2 circuit board.

The locking device may be made in its entirety of metal (e.g., steel), or it may be made of a hard plastic with a metal piece serving as the part which is projects from the connector and is pressed into the input terminal.

Significance of the Functions of the Anti-theft Alarm Cable in Different Fields Application:

Where the anti-theft alarm cable is used as an anti-theft device for electrical equipment in institutions where an unauthorised person can operate unseen, such as in schools and hospitals etc., it is just as necessary to encapsulate the sound unit in the connector, as to provide the connector with a locking device which secures it to the input terminal.

Where the anti-theft alarm cable is to be used to secure goods on display in shops selling electrical goods and computers, at trade fairs and the like, the encapsulation of the sound unit in the connector is necessary, but the locking device in the connector may be unnecessary if the premises are surveyable.

The other features of the invention relate to all fields of application.

Various Alarm Types that can be Integrated in the Anti-theft Alarm Cable.

1. MICROSWITCH-BASED ALARM: The circuit between the sound generator and the battery can be closed by a normally closed loop via the opening of microswitches in a connector and/or plug. The microswitches are placed with the pressure arm in such a way that they are closed on connection to and opened on disconnection from the input terminal and/or wall socket.

The circuit between the sound generator and the battery can also be closed by a combination of a loss of the mains voltage and the opening of the loop via the microswitches in the connector and/or plug. Thus, the anti-theft alarm cable can distinguish between a regular power failure and an attempted theft. A circuit of this type may advantageously be MCU-based, also having a transformer which converts voltage from the mains supply to a low direct voltage, which supplies power to PCB 2 and charging voltage to the accumulator. The transformer may be encapsulated in the plug. Complete diagram in FIGS. VIIa), b) and c).

2. RELAY-BASED ALARM: The sound generator and battery may be connected to a relay which closes the circuit between them when there is a loss of mains voltage through the power cable connected to the relay coil. The mains voltage may, for example, be conducted through a break in one of the poles of the connector in order to register that the power cable is connected to the appliance to be secured, or alternatively: an AC switch which supplies control voltage to the relay is so positioned in the connector that it can be opened or closed upon disconnection or connection of the connector in the input terminal, and in this way trigger the alarm when the anti-theft alarm cable is disconnected from the mains supply or the electrical appliance it is to secure.

3. MOVEMENT DETECTOR BASED ALARM: The circuit between the sound generator and battery can pass via a mercury switch located in the connector, and be closed when the mercury switch is triggered because of unauthorised movement. PCB 2 may be microcontroller-based, and the mercury switch may then be connected to the microswitch input on the diagram in FIG. VIIc).

4. ALTERNATIVE EMBODIMENTS: In embodiments nos. 1 and 2 the relay can be replaced by a PCB 2 which registers a loss of mains voltage in a number of known ways.

Microswitches may be replaced with other known techniques for cable break detection. Known techniques for cable break detection include:

Light diodes with associated phototransistor which can be placed in the connector and/or plug in a position such that they register that they are connected to the input terminal and/or wall socket.

Magnetic blow-out circuit-breakers (half sensor/half element) which can be placed in the connector and/or plug in a position so that they are opened or closed by a magnet which is secured in or on the input terminal and/or the wall socket in a corresponding position relative to the magnetic blow-out circuit-breaker.

Pulse generator placed in an extra unit in the mains supply with which the anti-theft alarm cable PCB 2 communicates as long as the plug is connected to the mains supply.

In the above embodiments (1–4) an RF transmitter can be connected to output instead of to or in addition to a sound generator, so that pager or mobile phone signalling via a central monitoring machine (e.g., PC with modem) can be added as a function.

EXPLANATION OF THE FIGURES

The anti-theft alarm cable according to the invention is shown in the drawings, wherein FIG. 1*a*) shows a section of the connector seen from the side. (1) is the sound generator and (2) is the associated battery or accumulator. (3) indicates PCB 2, which may comprise all the components which can be seen from the diagram in FIG. VIIc). (4) is the keypad, (5) is the diaphragm with a natural frequency identical to that of the sound generator, and (6) indicates the resonance chamber of the sound generator. (7) indicates the position of the microswitches (tamper protection) which trigger the alarm in the event of external pressure on the rear part of the connector. (8) is the cable connecting the female connector of the anti-theft alarm cable to its male connector.

Figure 1A:
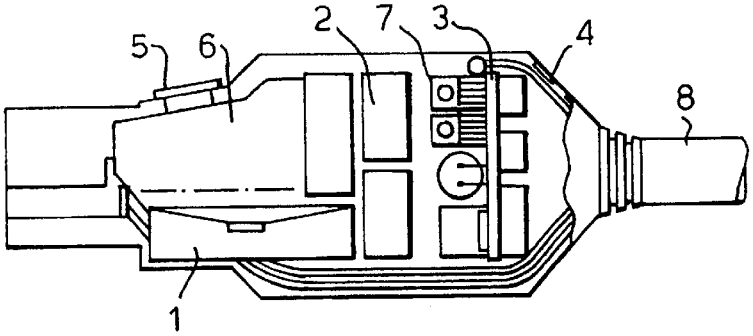
FIG. 1*b*) is a section of the connector seen from above, with the same reference numerals for the components as those used in FIG. 1*a*).
Figure 1B:
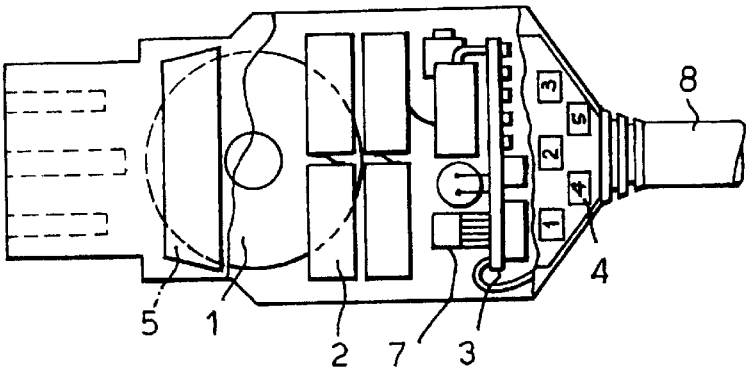
Figure 2A:
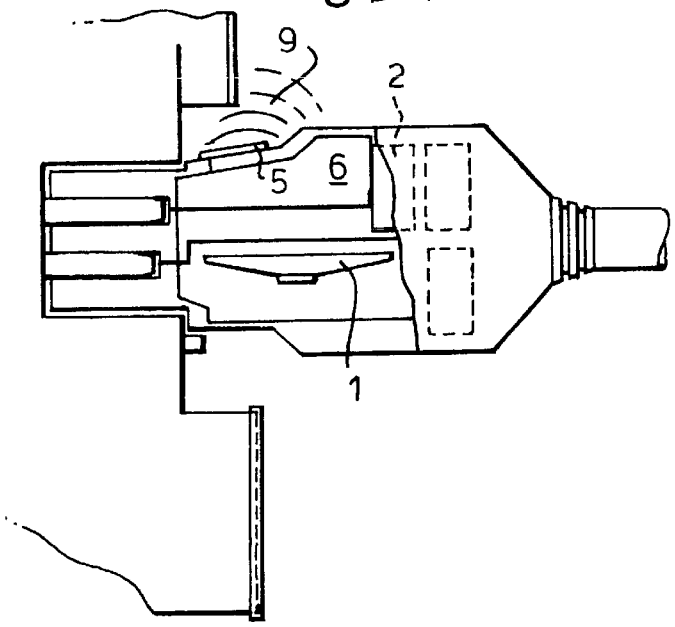
Figure 5:
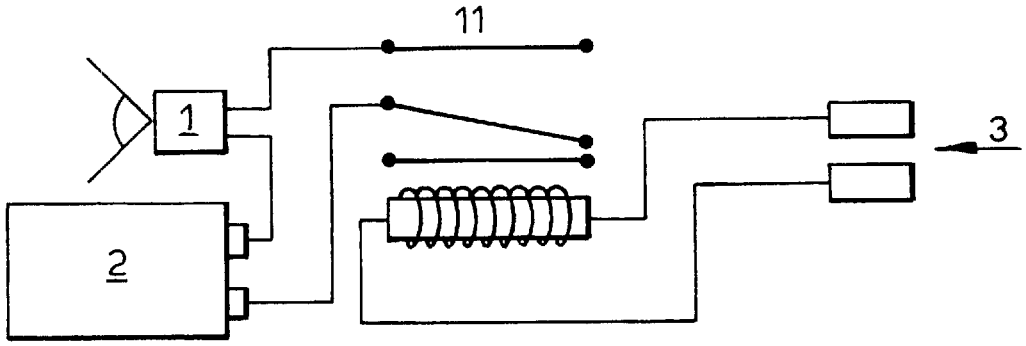
Figure 6A:
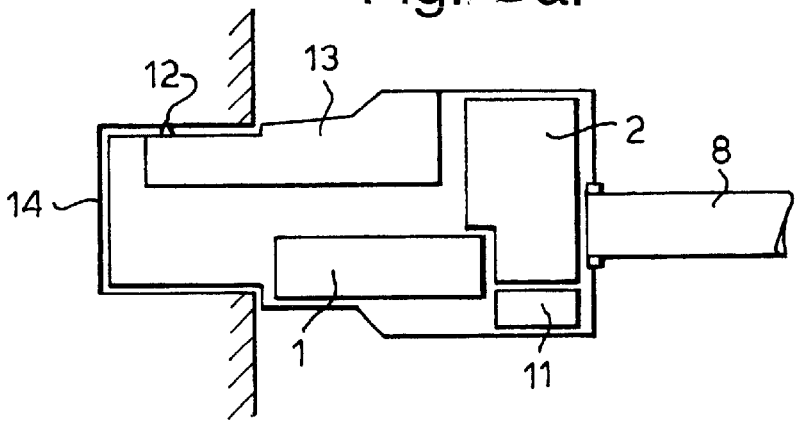
Figure 6B:
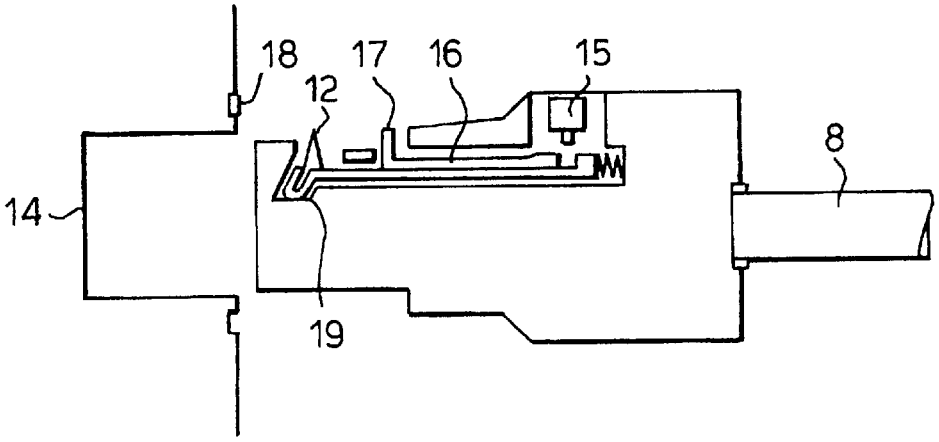
Figure 6C:
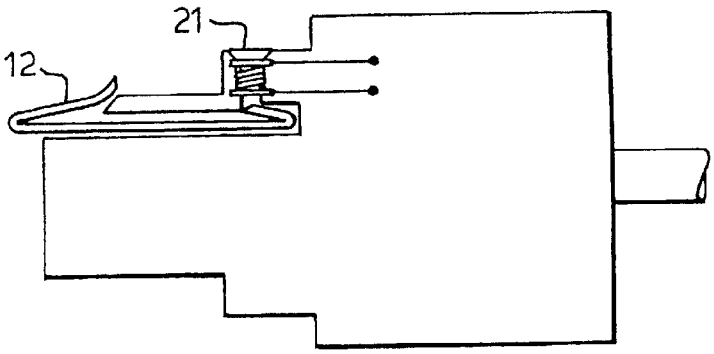
Figure 6D:
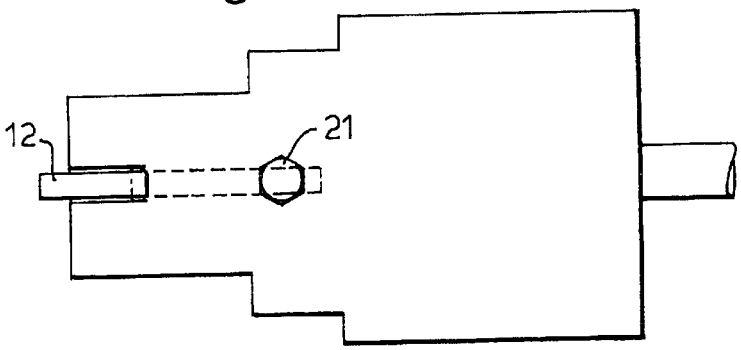
Figure 6E:
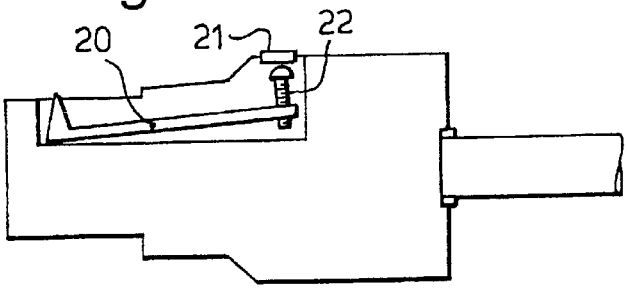
Figure 6F:
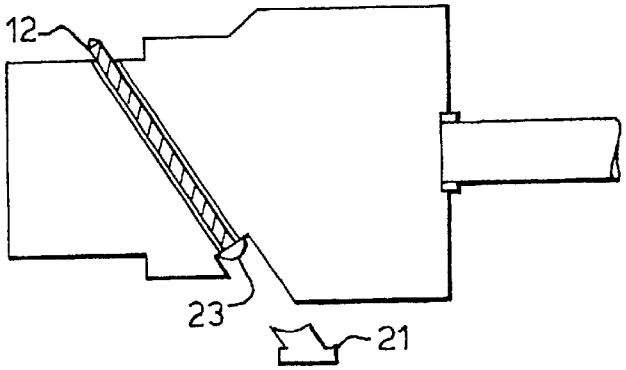
Figure 7A:
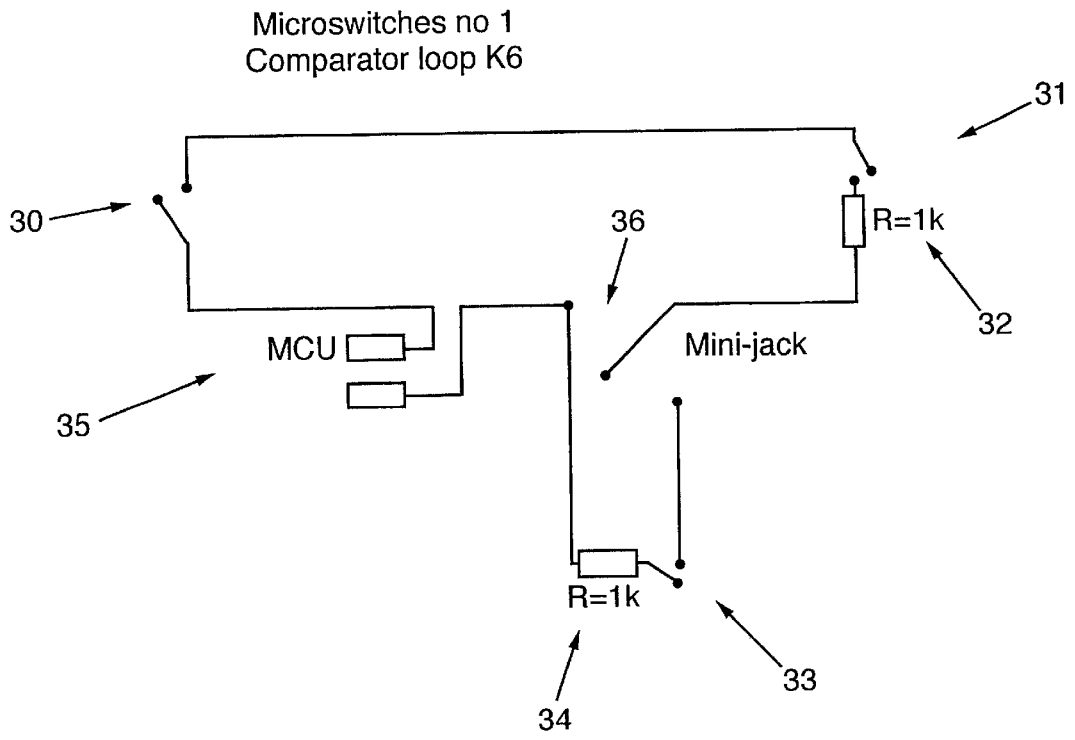
Figure 7B:
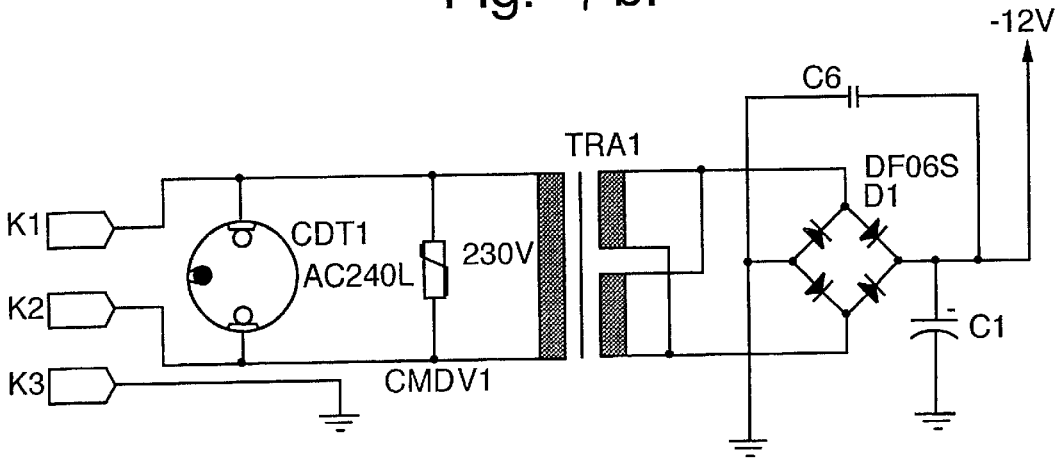
Figure 7C:
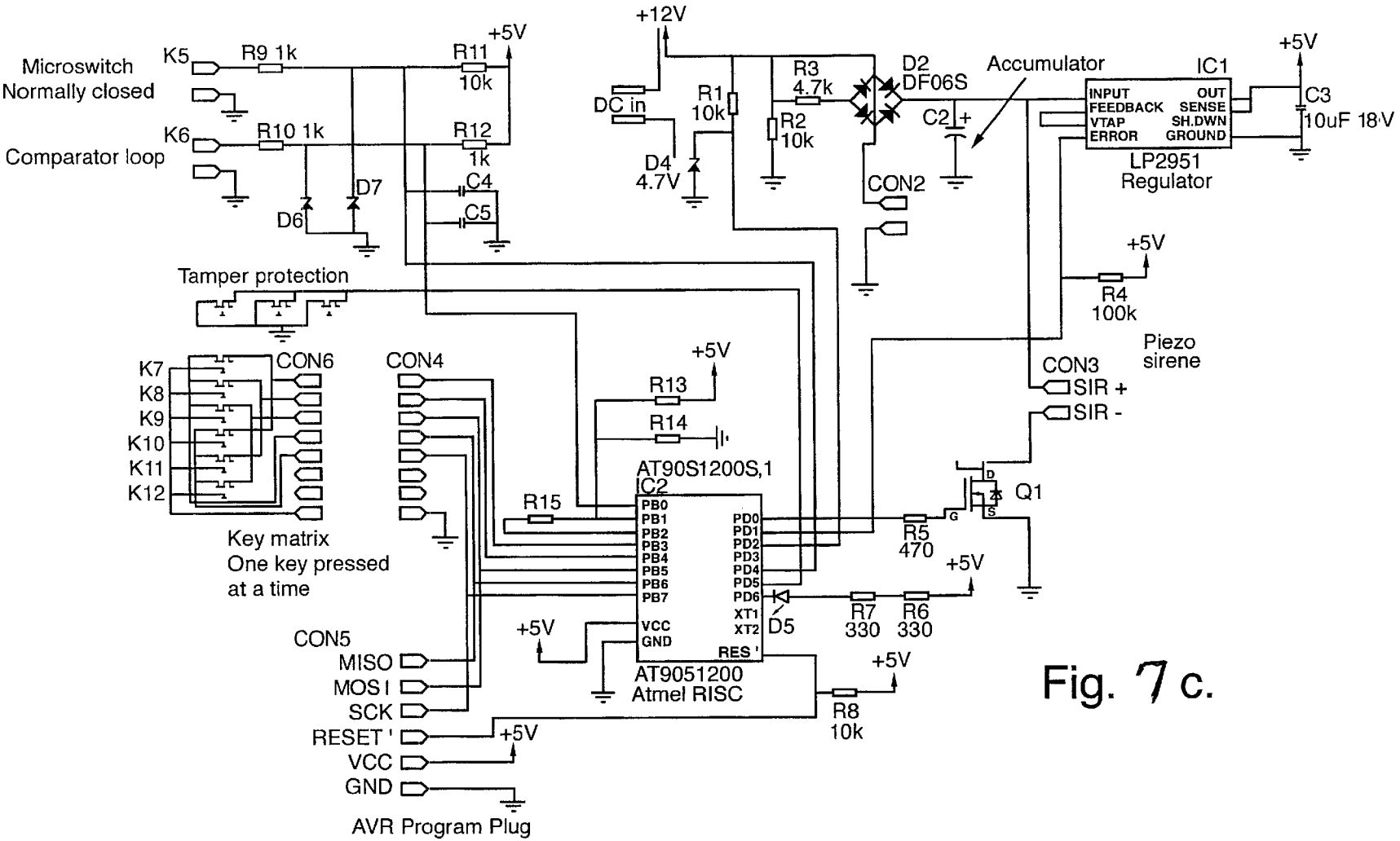
Figure 8A:
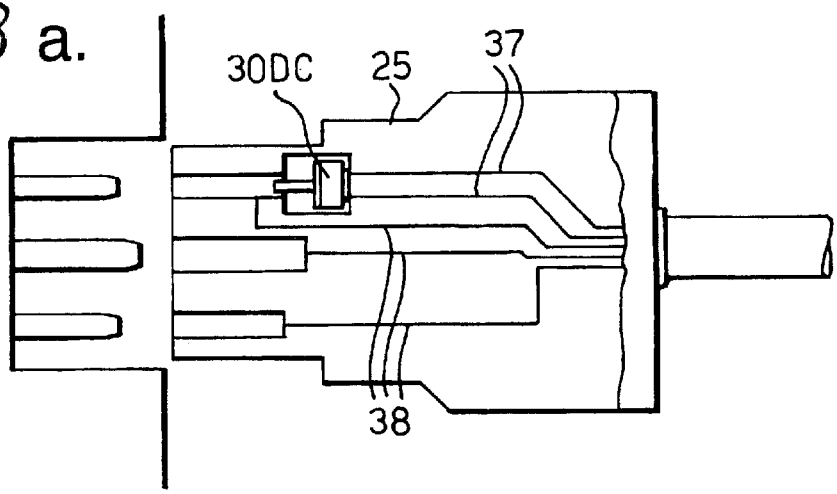
Figure 8B:
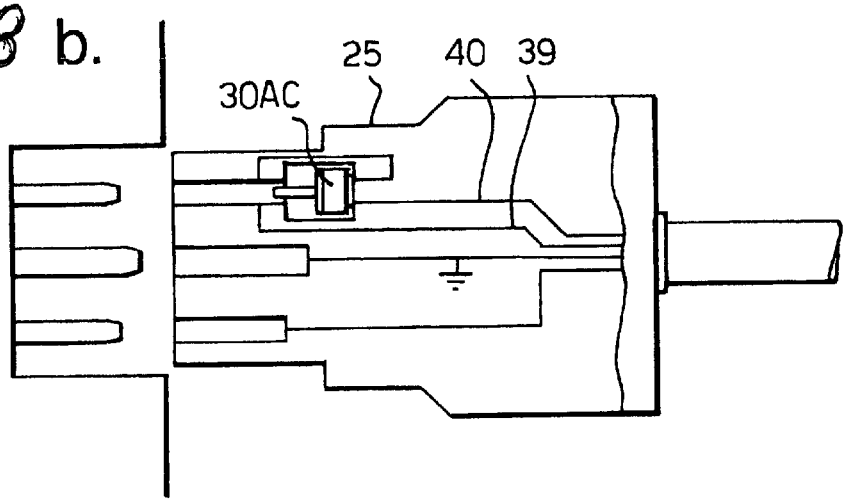
Figure 8C:
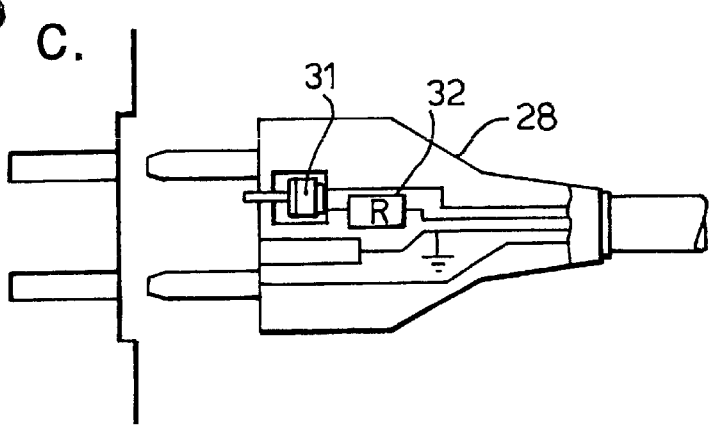

FIG. IIa) is a lateral section of the connector in a position where it is connected to a power input terminal on an appliance that is to be secured by the anti-theft alarm cable. When the diaphragm (5) produces sound waves which are reflected in the appliance chassis, the reflected waves will intersect the sound waves from the diaphragm in the points of intersection (9) and cause interference.

FIG. IIb) is a curve chart showing how the sound waves in the points of intersection (9) form an interference wave having more powerful amplitude than the non-amplified sound wave.

FIG. III) is a front view of the connector. (10) shows the position of sound holes capable of letting sound pass out directly from the resonance chamber of the sound generator.

FIG. IV) is a drawing of the whole anti-theft alarm cable presented as if transparent in order to show the position of the various components in the cable. (3) is PCB 2 which is only covered by the rubber of the cable, and (11) is a relay which closes the circuit between the sound generator and battery when there is a loss of relay to control current from PCB 2 (3). (25) indicates the whole of the connector, (26) indicates the front part of the connector, whilst (27) indicates the rear part of the connector. (28) is the plug, wherein the transformer (TRA1), varistor (GMOV), gas discharger (GDT1) and rectifier bridge are encapsulated.

FIG. V) is a diagram showing the connection of the sound generator (1) and battery (2) to a relay which closes the circuit between the sound generator (1) and battery (2) when there is a loss of relay control current from PCB 2 (3).

FIG. VIa) is a lateral section of the connector connected to an input terminal (14), wherein a metal piece (12) projects from the front part of the connector and into the input terminal (14) wall, so that the connector is locked in the input terminal. (13) indicates intended position of the raising and lowering mechanism of the metal piece (12).

FIG. VIb) is a lateral section of the connector not connected to an input terminal (14) which shows the raising and lowering mechanism (16) of the metal piece (12). When the connector is inserted into the input terminal (14), the raising member (17) of the raising and lowering mechanism (16) will meet the frame (18) around the input terminal, and thereby hold the locking device still whilst the connector is inserted further into the input terminal (14). Since the raising/lowering mechanism (16) is angled downwards (19) at the front edge thereof, and rests in a similarly angled groove (19) in the wall when the connector, the metal piece (12) will be raised out of the front part of the connector and into the wall of the connector when the connector is introduced into the input terminal, and in the same way (but the reverse) is lowered down into the front part of the connector when the connector is withdrawn from the input terminal. (15) is a screw, pin or electromagnetic coil bobbin which locks the raising/lowering mechanism (16) in its position after the connector has been introduced into the input terminal, FIGS. VIc) and d) show from the side and from above respectively a possible embodiment of the locking device wherein the metal piece (12) upon the insertion of the connector in the input terminal will first meet the input terminal bottom wall, and subsequently the sharp edge of the metal piece will be pressed up and into the input terminal wall by the underlying inclined part of the connector. The locking device is released by compressing the bent part of the other end of the metal piece, whereby the metal piece, when the connector is pulled out, can be released from the connector. A locking screw is disposed in the entry to the release function of the device. The locking screw functions as a cover (21) having a switching loop function for triggering the alarm in the event of unauthorised manoeuvring of the locking screw.

FIG. VIe) is a lateral section of the connector, and shows an alternative embodiment to that shown in FIG. VIb). In this case the metal piece (12) is pressed out of the front part of the connector by a lever which balances in the midpoint (20), and is pressed down or up by a screw (22), which subsequent to locking can be concealed from unauthorised persons by a cover (21) which closes a loop from PCB 2, so that unauthorised persons cannot gain access to the screw (22) without first triggering the alarm. This principle (with the cover (21) concealing the fixing screw (22 or 15)) can be used in the embodiments described in FIGS. VIa), b) and VIf).

FIG. VId) shows an alternative embodiment of FIGS. VIb) and c). In this case a screw (23) projects from the front part of the connector and forms the metal piece (12) which is screwed into the input terminal wall(s). The screw (23) can be concealed by a reinforced cover (21).

ELECTRONIC EMBODIMENTS

FIG. VIIa) is a diagram of a normally closed loop via microswitch (30) in a connector and resistor (32) and microswitch (31) in a socket outlet, and also via an optional (through jack input) loop to a switch (33) and resistor (34) in an external loop. This loop is connected to PCB 2 (3) in FIG. VIIc) in the contact points (K6). (30) opens the loop when the female connector is disconnected from the input terminal. (31) distinguishes between an attempted theft and power failure by closing or opening the loop when the male connector is connected to or disconnected from the wall socket. (32) registers cable cuts, by maintaining the resistance in the loop at a level which is monitored by the MCU comparator. The value R may vary through the series of cables produced. (33) opens the loop when the cover is separated from the chassis of an appliance secured by the anti-theft alarm cable. (34) registers cable cuts by maintaining the resistance in the loop at a level that is monitored by the MCU comparator. The connection of the external loop is optional in that the loop is closed (36) if the external loop is not connected.

FIG. VIIb) is a diagram of the AC part (transformer, varistor, gas discharger etc.) which is intended to be placed in the plug. The two phases from the mains supply are connected at contact points K1 and K2. The earth phase from the mains supply is connected to K3. The varistor and gas discharger are connected in parallel relation across the mains phase and short circuit the phases in the event of lightening or excess voltage. The transformer (TRA1) converts high alternating voltage into low direct voltage, which is supplied to the PCB 2 (FIG. VIIc) through two extra conductors in the cable (8) to the contact points +12 v and earth at D4. The rectifier bridge (D1) is a full bridge rectifier and (C1) is a small storage capacitor.

FIG. VIIc) is a diagram for PCB 2, which contains logics (MCU etc.) (3). RI directs a signal towards the microcontroller IC2 inlet PD2 pin 6 which indicates with high voltage (about 5 volts) that mains voltage is connected to the microcontroller through the transformer in PCB 1. From K6 a normally closed loop can run via microswitches in the plug and connector, as outlined in FIGS. VIIa). From K5 a normally closed loop can run via the locking device in the connector, and trigger the alarm when an unauthorised person tampers with this. "Tamper protection" in the figure shows several normally open microswitches connected in parallel relation which can be positioned with the pressure arm out towards the walls in the rear part of the connector, so that they are closed and trigger the alarm if someone pushes in the sides of the connector encapsulation. K7–K12 are the keypad (4), IC2 is the microcontroller which controls the circuit, and con3 represents the contact points of the sound generator (1).

FIG. VIIIa) shows the connector with a DC microswitch (30DC) which is connected to PCB 2 by the loop (37) at contact point (K6) in FIG. VIIc).

FIG. VIIIb) shows the connector (25) with an AC microswitch (30AC), wherein a phase (39) from the mains supply supplies the connector pole with current, and the AC microswitch conducts AC via conductor (40) back to contact point (K1) on PCB 1, so that PCB 1 only receives current when the connector is connected to the input terminal.

FIG. VIIIc) shows the plug (28) with a loop via a microswitch (31) and a resistor (32) which is connected to the contact point (K6) on PCB 2.

FIGS. VIIIa), b) and c) are different embodiments of microswitches in the connector and plug, all of which may be implemented in alarm types 1–4 in the description, in order to distinguish between a regular power failure and an attempted theft, to register that the anti-theft alarm cable is plugged into the appliance that is to be secured, and to register any short circuit of the cable (8).

What is claimed is:

1. An anti-theft alarming bipolar earthed power cable having at least two connectors, and an electrically driven sound generator (1) and a battery (2) encapsulated in a rear part of at least one of said at least two connectors, and wherein an electrical circuit between the sound generator (1) and the battery (2) is made when an attempt is made to remove the cable from an electrical appliance or from a mains supply when connected between the electrical appliance and a mains supply outlet, a sound diaphragm (5) positioned right against a front part (26) of said at least one of said at least two connectors and having a natural frequency of resonance which is an operating frequency of the sound generator (1), said at least one of said at least two connectors constituting a resonance chamber (6) having a front portion of a rear part (27) provided with a hole (10) arranged to conduct sound straight out of the resonance chamber (6), and wherein said at least one of said at least two connectors includes a locking device comprising a pointed metal element (12) attached to said at least one of said at least two connectors and arranged to protrude from a side portion of said at least one of said at least two connectors for engagement with an input terminal wall of an electrical appliance or mains supply outlet when inserted into said electrical appliance or mains supply outlet.

2. The anti-theft alarming bipolar earthed power cable according to claim 1, wherein the pointed metal element (12) constitutes an elongated metal piece (12) pressed out of a front portion of a side portion of said at least one of said at least two connectors and into an input terminal wall of said electrical appliance or mains supply outlet when inserted into said electrical appliance or mains supply outlet, said elongated metal piece (12) being part of a raising/lowering arrangement (16), wherein the elongated metal piece (12) at a front section adjacent to the connector includes a sloping portion (19), and is longitudinally movable in a groove (19) in a front part of the connector having a similarly sloping portion, such that the metal piece (12) by relative movement of the elongated metal piece (12) with respect to the connector is raised laterally out of the front portion of the connector when the connector is inserted into said electrical appliance or mains supply outlet.

3. The anti-theft alarming bipolar earthed power cable according to claim 2, wherein the raising/lowering arrangement (16) is arranged to lower the elongated metal piece (12) down into the groove in the front part of the connector when the connector is extracted after being inserted into said electrical appliance or mains supply outlet.

4. The anti-theft alarming bipolar earthed power cable according to claim 1, further comprising a screw, pin or electromagnetic coil bobbin (15) lock arrangement for locking the pointed metal element (12) in a raised position after insertion of a respective connector into said electrical appliance or mains supply outlet.

5. The anti-theft alarming bipolar earthed power cable according to claim 1, wherein a transformer, a gas discharge protector, a varistor and a rectifier bridge are encapsulated in at least one of said at least two connectors.

6. The anti-heft alarming bipolar earthed power cable according to claim 1, wherein a keypad is positioned at a point along the cable or on the outside of a rear portion of one of said at least two connectors.

* * * * *